US006748689B2

(12) United States Patent
Fitzpatrick

(10) Patent No.: US 6,748,689 B2
(45) Date of Patent: Jun. 15, 2004

(54) AMMUNITION MAGAZINES WITH INTEGRAL HANDLES

(76) Inventor: Richard Mark Fitzpatrick, 1109 Par Rd., Broomfield, CO (US) 80020

( * ) Notice: Subject to any disclaimer, the term of this patent is extended or adjusted under 35 U.S.C. 154(b) by 0 days.

(21) Appl. No.: 10/245,953

(22) Filed: Sep. 17, 2002

(65) Prior Publication Data

US 2003/0014896 A1 Jan. 23, 2003

Related U.S. Application Data

(62) Division of application No. 09/504,646, filed on Feb. 14, 2000, now Pat. No. 6,481,136.

(51) Int. Cl.[7] ..... F41A 9/25
(52) U.S. Cl. ..... 42/50; 89/34
(58) Field of Search ..... 42/7, 49.01, 50; 89/34

(56) References Cited

U.S. PATENT DOCUMENTS

| | | | | | |
|---|---|---|---|---|---|
| D33,384 | S | | 10/1900 | Thorne | |
| 753,414 | A | * | 3/1904 | Luger | |
| 1,067,054 | A | * | 7/1913 | Nardin | |
| 1,245,499 | A | | 11/1917 | Orme | |
| 1,460,672 | A | * | 7/1923 | Hines | |
| 1,797,951 | A | * | 3/1931 | Gaidos | |
| 1,800,595 | A | * | 4/1931 | Browning | |
| 2,137,491 | A | * | 11/1938 | Huff | 42/50 |
| 2,205,967 | A | * | 6/1940 | Wise | |
| 2,825,991 | A | * | 3/1958 | Stadelmann | 42/50 |
| 2,887,811 | A | * | 5/1959 | Johnson, Jr. | |
| 4,342,169 | A | * | 8/1982 | Lichtman | 42/11 |
| 4,442,962 | A | | 4/1984 | Musgrave | |
| 5,566,487 | A | | 10/1996 | Vaid et al. | |
| 5,906,065 | A | | 5/1999 | Pearce | |
| 6,212,815 | B1 | * | 4/2001 | Fitzpatrick | 42/90 |

FOREIGN PATENT DOCUMENTS

| | | | | |
|---|---|---|---|---|
| AT | 58306 | * | 3/1913 | 42/7 |
| GB | 3220 | | of 1908 | |
| GB | 875222 | * | 8/1961 | 42/50 |

* cited by examiner

*Primary Examiner*—Stephen M. Johnson
(74) *Attorney, Agent, or Firm*—Geoffrey E. Dobbin

(57) ABSTRACT

Integral extensions to aid in the extraction of ammunition magazines from ammunition pouches are provided in three embodiments. In this embodiment, the sides of an ammunition magazine are extended, either by molding or affixing a handle directly to the sides of the magazine, to provide a handle. This embodiment provides a more steam-lined handle adapted for use specifically in the extraction of magazines from ammunition pouches and other storage means.

18 Claims, 3 Drawing Sheets

AMMUNITION MAGAZINES WITH INTEGRAL HANDLES

CROSS-REFERENCES TO RELATED APPLICATIONS

This application is a divisional application of application Ser. No. 09/504,646, filed Feb. 14, 2000 now U.S. Pat. No. 6,481,136.

FIELD OF INVENTION

The present invention relates to the fashioning of extensions on ammunition magazines and more particularly to pull-tab and loop handle extensions that are positioned on the floor end of ammunition magazines by either replacing the floor plate, modifying the floor plate or extending the side magazine walls in order to aid with both the extraction of said ammunition magazine from ammunition pouches and the insertion into a weapon.

BACKGROUND OF THE INVENTION

The use of loops to aid in the removal of ammunition magazines from a storage compartment is known in the prior art. Likewise, the use of handle attachments or tabs or other extensions to carry ammunition magazines and other objects is also known. These attachments and modifications, while suitable for their individual purposes, are not as suitable for the purpose of this invention, namely providing an extension that is of one piece with an ammunition magazine or with the floor plate of said magazine for the purpose of extraction of said magazine from ammunition pouches worn on the user. For example, the current practice of forming duct tape tabs and cord loops on ammunition magazines; U.S. Pat. No. 6,212,815 to Fitzpatrick; U.S. Pat. No. 5,566,487 to Vaid; U.S. Pat. No. 4,442,962 to Musgrave; U.S. Pat. No. 2,825,991 to Stadelmann; U.S. Pat. No. 2,205,967 to Wise; U.S. Pat. No. 1,797,951 to Gaidos; U.S. Pat. No. 1,245,499 to Orme; U.S. Pat. No. 888,560 to White; and U.S. Pat. No. D-33,384 are all illustrative of the prior art.

Currently, in the field, soldiers use either loops of parachute cord attached to ammunition magazines by duct tape or they form tabs by folding duct tape over the butt end of their ammunition magazines. The loops and tabs aid soldiers in the extraction of said magazines from ammunition pouches carried on the user. However, the duct tape tends to wear and often needs replaced. The duct tape also leaves a sticky residue when removed and provides no other benefit other than the increased friction or fastening a pull loop to the ammunition magazine. Soldiers have also extracted the inside portion of a length of parachute cord, leaving the casing, tied said casing together and positioned the formed loop so that it encircles the floor plate of an ammunition magazine before they replaced said floor plate, with the loop, in the magazine. Thus they have formed a loop, extending from the bottom of the magazine.

While the aforementioned inventions accomplish their individual objectives, they do not describe an integral extension that is used primarily for the extraction of ammunition magazines from ammunition pouches, as evidenced by the duct tape modifications used in the field. Handle and loop attachments used in the prior art are mainly used for affixing an ammunition magazine to other objects, such as clothing or vehicles. In one of the two cases where handle attachments are used for extraction, the handle is a simple metal wire forming a loop and is not adapted for use in the various positions a user may wear an ammunition pouch. There are also disadvantages with the duct tape modifications, particularly regarding removal and in the amount of slack in a loop of parachute cord. Fitzpatrick '815 discloses a handle attached to an external sleeve, not a handle integral with the walls of the magazine. None of the other disclosed patents have a handle integral with the walls of the magazine. In this respect, the extensions according to the present invention depart substantially from the usual designs in the prior art. In doing so, this invention provides handle extensions integral with the walls of ammunition magazines that are primarily designed for the purpose of aiding the extraction of ammunition magazines from pouches worn on the user.

SUMMARY OF THE INVENTION

In view of the foregoing disadvantages inherent in the known types of attachments and grip extensions, this invention provides extensions for use on the base of ammunition magazines. As such, the present invention's general purpose is to provide new and improved integral extensions that will aid in the extraction of ammunition magazines from pouches worn on the user.

To attain this, the invention has three individual embodiments. The first embodiment essentially comprises a replacement floor plate, typically molded of a hard plastic or metal, with a tab or loop extending from the replacement floor plate, typically molded from a more resilient plastic or thermoplastic compound. The product would be manufactured by using a bifurcated molding process where the floor plate portion would be molded first and the extension would be molded onto the floor plate in a second molding step. Alternatively, the floor plate may be molded or fashioned with at least one anchoring hole and the handle then either injection molded onto the floor plate or pre-molded with at least one anchoring means and mechanically coupled to the floor plate. The second embodiment would require retrofitting all existing floor plates with at least one anchoring hole along the center of their elongated sides or boring a plurality of holes through a floor plate and either injection molding or mechanically coupling a handle onto the floor plate. In the third embodiment, a plastic magazine would be molded with a resilient loop or tab on its base end or a handle may be attached to the base end by mechanical, ultrasonic welding, or adhesive means. This application focuses on the third embodiment.

These designs have numerous advantages over the prior art. First, the extensions are integral with the magazine and have a lower incidence of grip failure. Second, the standard means of ejection causes the butt end of the magazine to impact the ground. The molded handle portion acts as a shock absorber for the magazine when it is ejected from the rifle and reduces impact damage to the magazine. Third, the extensions abut against the lid of the pouch. This abutment effectively anchors the magazine against the pouch lid and reduces noise caused by the rattling of magazines against pouch when the user is moving.

The more important features of the invention have thus been outlined in order that the more detailed description that follows may be better understood and in order that the present contribution to the art may better be appreciated. Additional features of the invention will be described hereinafter and will form the subject matter of the claims that follow.

The primary object of the present invention is to provide integral extensions for use on ammunition magazines to aid in their extraction from ammunition pouches.

Other objects of this invention will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENT

Figure 1:
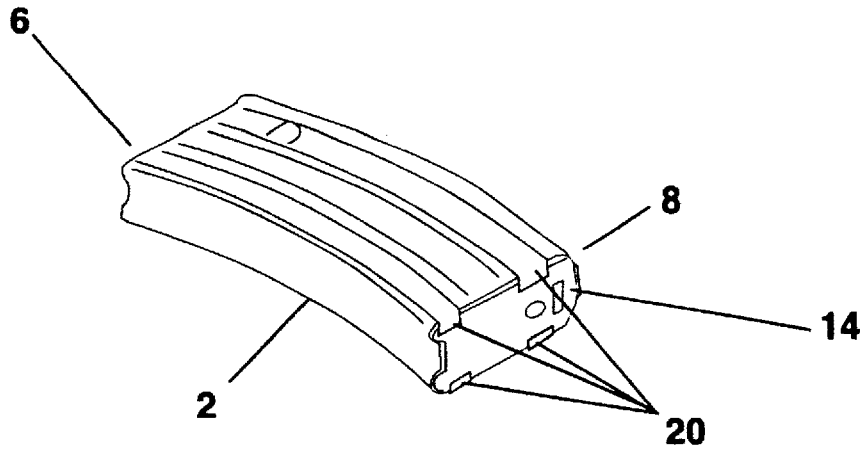
FIG. 1 is a perspective view of a standard M-16 magazine.
Figure 2:
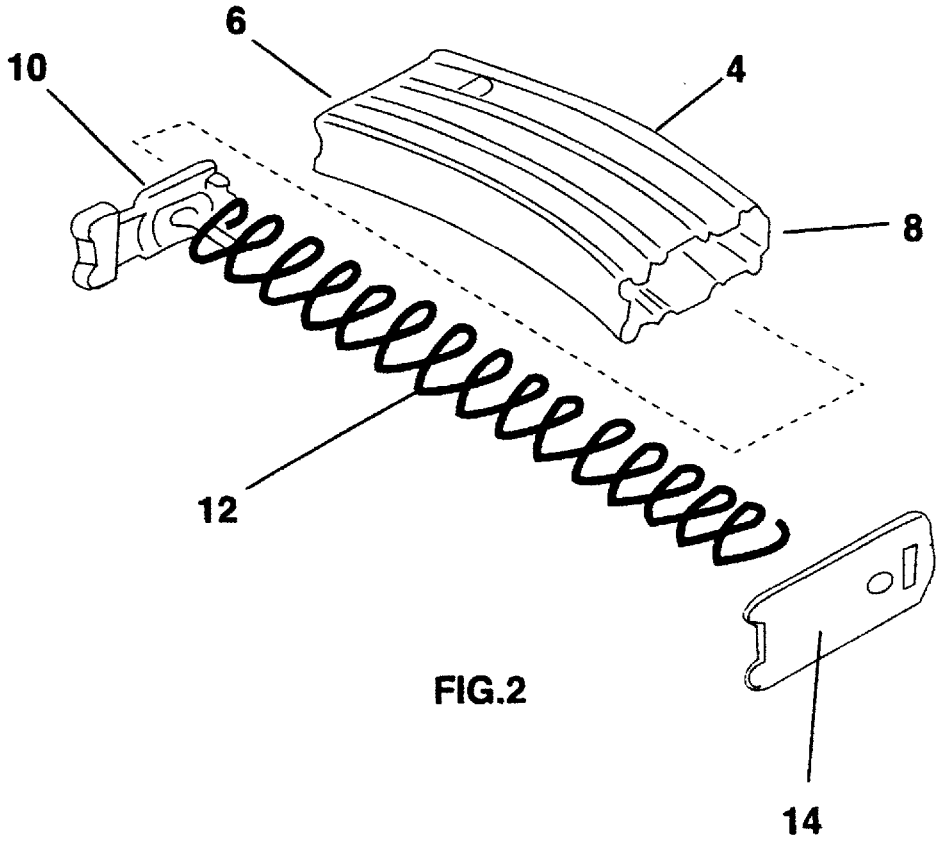
FIG. 2 is an exploded view of the magazine in FIG. 1.

With reference now to the drawings, the preferred embodiment of the new and improved integral extensions for ammunition magazines embodying the principles and concepts of the present invention will be described. Specifically, it will be noted in the figures, especially FIGS. 3, 4, 5, and 6 that the invention relates to the addition of extensions to the sidewalls of ammunition magazines. Before the invention can be explained, a brief description of the structure of an ammunition magazine, shown in FIGS. 1 and 2, is necessary. The generic magazine 2 is a relatively simple structure. The outer casing 4, formed by four sidewalls, is suitably sized and shaped to receive ammunition. The casing 4 has a feed end 6 and a floor, or butt, end 8. The feed end 6 is designed to engage the weapon. Inside the casing, a follower plate 10 is in contact with the follower spring 12, which is in turn, in contact with the floor plate 14. When ammunition is loaded into the feed end 6, the follower plate 10 compresses the follower spring 12 against the floor plate 14. This compression is relaxed when a round of ammunition is loaded into the weapon's firing chamber and the spring 12 therefore raises the follower plate 10, and associated ammunition relative to the magazine 2 and weapon. The raising readies the next round of ammunition for loading into the weapon's firing chamber after the first round's casing is expelled.

Figure 3:
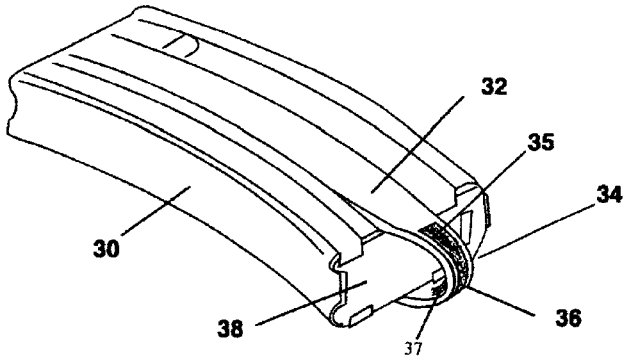
FIG. 3 is a perspective view of the invention detailing the side extension embodiment.
Figure 4:
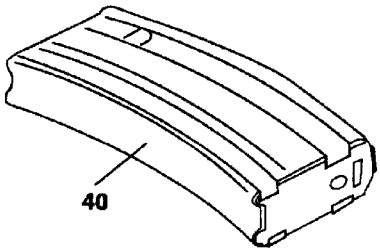
FIG. 4 is an exploded view of the adhesive embodiment of the invention.
Figure 4A:
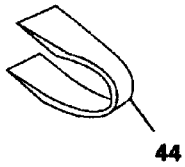
FIG. 4*a* is a perspective view of the invention in FIG. 4 assembled.
Figure 4A:
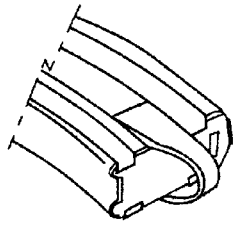
Figure 5:
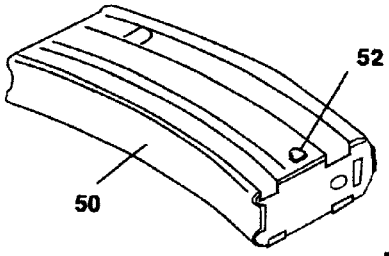
FIG. 5 is an exploded view of the invention using anchoring nodes on the magazine.
Figure 5A:
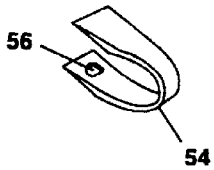
FIG. 5*a* is a perspective view of the invention in FIG. 5 assembled
Figure 5A:
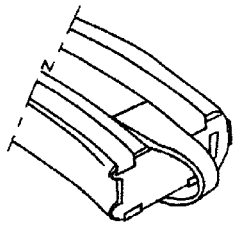
Figure 6:
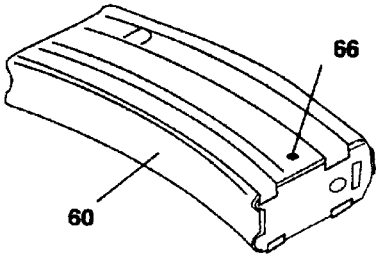
FIG. 6 is an exploded view of the invention using rivets to fasten the handle to the magazine.
Figure 6A:
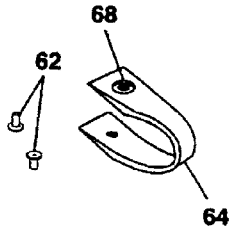
FIG. 6*a* is a perspective view of the invention in FIG. 6 assembled.
Figure 6A:
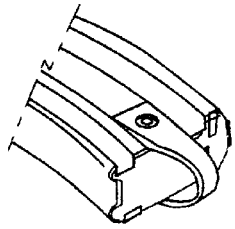
Figure 7:
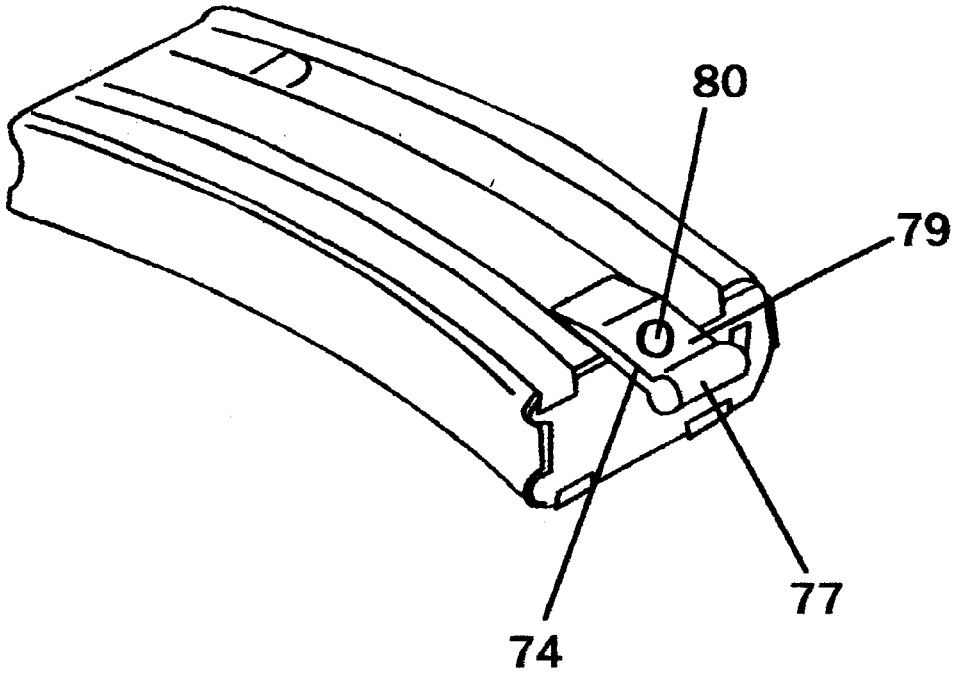
FIG. 7 is a perspective view of the invention with a single wall extended, thereby forming a tab.

The preferred embodiment of the invention, shown in FIGS. 3, 4, and 7, at least one wall 32 of an ammunition magazine 30 is extended above the level of the floor plate 38. The extension 35 may be fashioned into whatever shape a user desires, including extending a plurality of sides and molding them together, such as a loop 34 in FIG. 3 or the tab 74 in FIG. 7. A handle may be added to the magazine in a number of different methods. Referring to FIG. 5, the magazine may be molded with an anchor point 52 and a separate handle 54 may be either molded onto the anchor directly or may be ultrasonically welded onto the magazine 50. Handle 54, if molded separately, may have molded notch 56 to interface with the anchor point 52. A handle may also be attached mechanically to a magazine, such as by the rivets 62 shown in FIG. 6 or by an adhesive anchoring base 42 in FIG. 4. In FIG. 4, the improvement is the use of the handle 44, which is superior to parachute cord and may be molded in any fashion disclosed above, along with broad adhesive bases 42, with a temporary adhesive backing 44. Unlike the "para-cord loops" the handle does not move relative to the magazine, allowing for the entire range of benefits of use of the handles with a lower cost than other handle embodiments.

Referring to FIG. 3, the handle 34 should extend approximately 1.5 to 1.75 inches above floor plate 32. This will enable the handle 34 to engage the lid of an ammunition pouch and also allow enough space to remove the floor plate 32, if necessary. With the loop handle version, the handle 34 should have a width varying from 1.0 to 0.5 inch. The handle 34 is thicker at its apex 36 so as to better withstand the stress of pulling the invention and the magazine out of the ammunition pouch by the handle 34. The width of handle 34 at apex 36 is less than the rest of handle 34 so that a user's finger may curl around handle 34. For ease of fabrication and to increase friction between a finger and the handle 34, the underside of the apex 36 may be molded in a "step-like" pattern. For the purposes of this application, a "step-like" pattern consists of a series of parallel surfaces, each at a different relative level from the surfaces immediately adjacent to the given surface.

To utilize a tab style handle, shown in FIG. 7, handle 74 may be molded with a variety of shapes, including but not limited to ovals, cylinders, knobs, and wedges. Ideally, handle height should be between 1.0 and 1.75 inches. No limitation as to shape should be inferred from the drawings. For the illustrated variation, a small, reinforced hole 80 is provided in the handle 74 so that a user may hook the magazine onto a carabineer after ammunition is spent. In both variations, roughened recessed areas 35, 79 should be provided. In the loop version, recessed area 35 extends along the length of handle 34. The shape of handle determines recessed areas with the tab version shown in FIG. 7. For the version of the tab shown in FIG. 7, recessed areas 79 are provided on the planar faces of the handle 74. Also, the top of the handle 74 is molded with a ridge 77 to facilitate gripping.

Although the present invention has been described with reference to preferred embodiments, numerous modifications and variations can be made and still the result will come within the scope of the invention. No limitation with respect to the specific embodiments disclosed herein is intended or should be inferred.

I claim:

1. An improved ammunition magazine comprising:

a magazine body with sidewalls, a feed end for interfacing with a given weapon, a floor end opposite the feed end and a removable floor plate covering said floor end, the part of the magazine between the floor plate and the feed end being defined as below the level of the floor plate; and, a handle extending from at least one sidewall of said magazine, the handle extending from at least one sidewall above the level of the floor plate, thereby providing an integral extraction handle;

wherein the presence of the handle does not interfere with the removal of the floor plate.

2. The improved magazine of claim 1, wherein a plurality of walls are extended and joined together in one piece to form an integral extraction handle.

3. The improved magazine of claim 2, wherein the handle is a loop protruding from opposite magazine sidewalls, the loop defining an apex, with an underside facing the remainder of the magazine.

4. The improved magazine of claim 3, wherein at least one recessed area is fashioned along the loop, each at least one recessed area thus defining an interior areas.

5. The improved magazine of claim 3, wherein the underside of the apex of the handle is molded with greater thickness with respect to the rest of said handle.

6. The improved magazine of claim 5, wherein the underside of the apex of the handle is fashioned in a step-like pattern.

7. The improved magazine of claim 5, where the underside of the apex of the handle is roughened to increase friction between the handle and a finger used to extract the magazine.

8. The improved magazine of claim 4, wherein an interior area of at least one of the recessed areas is roughened to increase friction for grasping said handle.

9. The improved magazine of claim 8, wherein the handle measures 1.5 to 1.75 inches in height and 0.5 to 1 inch in width.

10. The improved magazine of claim 9, wherein the underside of the apex of the handle is molded with greater thickness with respect to the rest of said handle.

11. The improved magazine of claim 10, wherein the underside of the apex of the handle is fashioned in a step-like pattern.

12. The improved magazine of claim 10, where the underside of the apex of the handle is roughened to increase friction between the handle and a finger used to extract the magazine.

13. The improved magazine of claim 8, wherein the underside of the apex of the handle is molded with greater thickness with respect to the rest of said handle.

14. The improved magazine of claim 13, wherein the underside of the apex of the handle is fashioned in a step-like pattern.

15. The improved magazine of claim 13, where the underside of the apex of the handle is roughened to increase friction between the handle and a finger used to ex-tract the magazine.

16. The improved magazine of claim 4, wherein the underside of the apex of the handle is molded with greater thickness with respect to the rest of said handle.

17. The improved magazine of claim 16, wherein the underside of the apex of the handle is fashioned in a step-like pattern.

18. The improved magazine of claim 16, where the underside of the apex of the handle is roughened to increase friction between the handle and a finger used to extract the magazine.

* * * * *